US006216292B1

(12) United States Patent
Oakhill et al.

(10) Patent No.: US 6,216,292 B1
(45) Date of Patent: Apr. 17, 2001

(54) PROTECTIVE MATTRESS COVER WITH APRON

(75) Inventors: Timothy Oakhill, Atlanta, GA (US); Anna Stevenson, North Salt Lake City, UT (US)

(73) Assignee: Simmons Co., Atlanta, GA (US)

( * ) Notice: Subject to any disclaimer, the term of this patent is extended or adjusted under 35 U.S.C. 154(b) by 0 days.

(21) Appl. No.: 09/348,140

(22) Filed: Jul. 6, 1999

Related U.S. Application Data

(63) Continuation-in-part of application No. 09/109,421, filed on Jul. 2, 1998.

(60) Provisional application No. 60/045,934, filed on May 8, 1997.

(51) Int. Cl.[7] ..... A47G 9/02

(52) U.S. Cl. ..... 5/482; 5/493; 5/907

(58) Field of Search ..... 5/482, 485, 486, 5/487, 493, 494, 498, 907, 496; 40/309, 594; 24/725

(56) References Cited

U.S. PATENT DOCUMENTS

| | | | | |
|---|---|---|---|---|
| 2,188,576 | * | 1/1940 | Mulloy | 5/498 |
| 2,339,828 | | 1/1944 | Worth . | |
| 2,537,652 | | 1/1951 | Churchill . | |
| 2,598,884 | | 5/1952 | Bailen . | |
| 2,861,280 | | 11/1958 | Sachs . | |
| 3,258,789 | * | 7/1966 | Banks | 5/485 |
| 4,538,312 | | 9/1985 | Marki et al. . | |
| 4,587,683 | * | 5/1986 | Gardiner | 5/493 |
| 4,599,756 | | 7/1986 | Koffler . | |
| 4,884,305 | * | 12/1989 | Blackmon | 5/496 |
| 5,327,595 | * | 7/1994 | Allen | 5/496 X |
| 5,423,711 | | 6/1995 | Dorland . | |
| 5,477,633 | | 12/1995 | Leinberger . | |
| 5,497,521 | | 3/1996 | Waits et al. . | |
| 5,509,156 | | 4/1996 | Smith . | |
| 5,572,754 | | 11/1996 | Lazar et al. . | |
| 5,718,010 | | 2/1998 | Beier . | |
| 6,014,782 | * | 1/2000 | Stevenson | 5/482 X |

FOREIGN PATENT DOCUMENTS

| | | |
|---|---|---|
| 2145330 | 3/1985 | (GB) . |

* cited by examiner

*Primary Examiner*—Michael F. Trettel
(74) *Attorney, Agent, or Firm*—Smith, Gambrell & Russell, LLP

(57) ABSTRACT

A protective cover for the foot of a mattress comprises a web of preferably clear plastic that is rectangular and generally elongate. The web wraps around the foot of the mattress overlapping itself beneath the mattress where it is tightly secured to itself by hook and loop fastening material. Attached to the web along an upper edge thereof at the end of the mattress is an apron which hangs down covering the mattress end. The web serves to protect the mattress from soiling during testing by a consumer while the apron serves to provide for information indicia about the mattress brand, style and the like.

14 Claims, 1 Drawing Sheet

PROTECTIVE MATTRESS COVER WITH APRON

This application is a continuation-in-part application of co-pending U.S. patent application Ser. No. 09/109,421, filed on Jul. 2, 1998, which is a continuation-in-part of U.S. Provisional Patent Application Ser. No. 60/045,934, filed on May 8, 1997.

BACKGROUND OF THE INVENTION

1. Field of the Invention

The present invention relates generally to a combined mattress cover with an attached apron for covering the foot end of a mattress and, more particularly, to a combined mattress cover and apron for use in retail showrooms which not only protects a mattress from being soiled while it is tested by a customer, but also serves to clearly identify the brand name and other information relating to the demonstrated mattress.

2. Description of the Related Art

Before a customer purchases a new mattress, retailers and manufacturers recommend that the customer "test rest" the mattress. That is, the customer should fully lie on the mattress. By fully lying on the mattress, the customer can better compare the comfort of one mattress to another. However, some customers are reluctant to fully test rest a mattress because their shoes tend to soil or damage the mattress surface. Instead, such customers simply sit on anedge of the mattress or partially lie on the mattress with their feet dangling over a side of the mattress.

To encourage customers to test rest mattresses, some retailers and manufacturers have provided protective coverings placed over the foot end of the mattress. Such coverings include fitted sleeves which slide onto the end of the mattress. However, a disadvantage of these fitted sleeves is that they tend to easily fall off the end of the mattress after one or more customers test the mattress. One reason the fitted sleeves fall off is because mattresses vary in thickness. Although the width and length of mattresses have been standardized to fit available bed frames, the thicknesses of mattresses can vary between eight inches to fifteen or more inches. This makes it difficult for a sleeve cover to adequately fit various sized mattresses. As an alternative, vinyl covers have been sewn on the foot ends of mattresses for protection. However, such construction necessarily adds to manufacturing expense and consequent cost of the mattress. Also, a sewn vinyl cover can be ripped by a consumer testing the mattress. When this happens, the mattress must be sent back to the manufacturer for recovering and repair.

As a separate matter, retail showrooms for mattress sales typically contain a large number of mattresses having different characteristics and quality and also representing different manufacturing entities and brand names. As a consequence of the variety of available mattresses on display at the typical retail outlet, a consumer can easily become confused as to which product he or she has tested and finds preferable. Accordingly, it is desirable to provide a means for prominently displaying the brand, logo or product destination of a mattress in a showroom in direct association with a particular mattress product. It is further desirable to display such information in not only an attractive and tasteful manner, but also in a manner which will not interfere with the consumer's testing of the mattress. Further, it is desirable to display such information in a convenient and cost-effective manner. Still further, it is desirable to provide a means for prominently displaying the brand and other source identifying information of a mattress while at the same time providing means for protecting the foot end of the mattress effectively against soiling during testing by the consumer.

SUMMARY OF THE INVENTION

The present invention improves over other known mattress covers by providing a combined cover and apron for the foot of a mattress which can fit mattresses having varying thicknesses. The mattress cover wraps around the foot of the mattress and adjustably connects to itself underneath the mattress or to the box spring decking material beneath the mattress. In this way, the mattress cover can firmly wrap mattresses having vary thicknesses. The mattress cover is preferably made of a clear material so that the mattress appearance, product information, labels and manufacturer's logos are not obscured. A separate apron is attached to the mattress cover once the cover is in place. The apron hangs down over the foot end of the bed and is provided with manufacturer's logos, brand name identification and the like such that a consumer can easily recognize a mattress that he or she has tested.

BRIEF DESCRIPTION OF THE DRAWINGS

The foregoing and other novel features and advantages of the invention will be better understood upon a reading of the following detailed description taken in conjunction with accompanying drawings wherein.

DETAILED DESCRIPTION OF THE PREFERRED EMBODIMENTS

Figure 1:
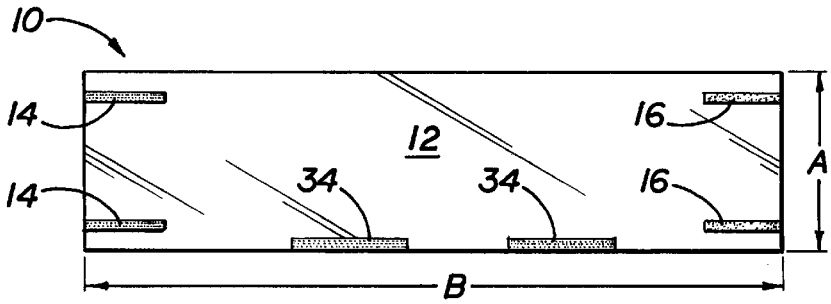
FIG. 1 is a plan view of mattress cover constructed in accordance with the principles of the invention.

Referring now to the drawings, and initially to FIG. 1, a mattress cover constructed in accordance with one form of the invention is designated generally by the reference numeral 10 and includes as a principal component a generally elongate, rectangular web 12 of flexible material. A currently preferred material for the web 12 is a clear vinyl having a thickness of 10 gauge, although other thicknesses may perform quite adequately. The 10 gauge material is sturdy, wears well and is readily available. A clear material also permits the mattress appearance to be readily visible as well as allowing the consumers to view any labels attached to the mattress bearing product information and manufacturer's logos, for example.

A web width, as measured at "A", of 20 inches is most desirable because the vinyl material is available in standard 40-inch wide rolls. The length of the web 12, as measured at "B", can vary depending upon the particular size of the mattress to be covered. For example, for a twin-size mattress which typically measures 39 inches wide, a preferred length for the web is 104 inches. For a queen-size mattress which typically measures 60 inches in width, a preferred web length is 160 inches. For a king-size mattress which typically measures 76 inches in width, a preferred web length is 195 inches. These preferred web lengths assure that the web overlaps itself sufficiently when wrapped around a given mattress, as will be described hereinafter.

Figure 2:
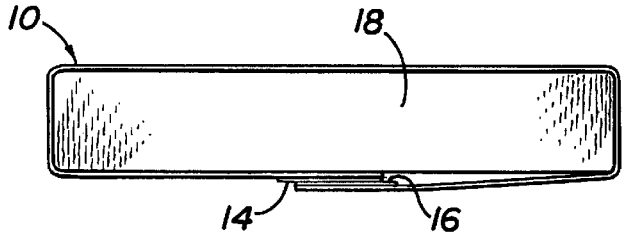
FIG. 2 is an end view of a mattress having the cover of FIG. 1 installed thereon.

As seen in FIG. 1, the cover 10 is provided in one form of the invention with hook and loop fastening means. A pair of hook strips 14 may be secured at one end of the web 12 as by sewing or the use of an adhesive. At the opposite end of the web 12 and on the opposite side thereof a pair of loop strips 16 may be similarly secured. As shown in FIG. 2, the cover may thereby be firmly wrapped around the foot of a typical mattress 18 with the hook and loop strips in engagement with one another thereby securing the cover 10 to the mattress. It has been found that hook and loop strips 14, 16 of 14 inches in length perform acceptably in securing the cover 10. The strips 14, 16 may be spaced slightly inwardly of the edges of the web 12.

Figure 3:
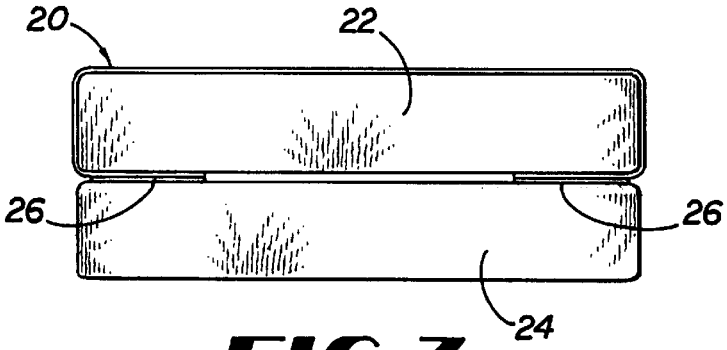
FIG. 3 is an end view of an alternative embodiment of a mattress cover shown as installed on a mattress and box spring.

Turning now to FIG. 3, an alternative embodiment of the invention is illustrated showing a cover 20 which is shorter than the cover 10 illustrated in FIG. 1. In this embodiment, the cover 20 is designed to wrap around the foot of a mattress 22 and to be secured in place by attachment to the decking cloth on the top of an associated box spring 24. Instead of having hook strips on one end of the mattress cover and loop strips on the other end, the cover 20 is provided with hook strips 26 at both ends. This configuration allows the mattress cover 20 to wrap around the mattress and attach directly to the decking cloth on the box spring underneath the mattress.

Figure 4:
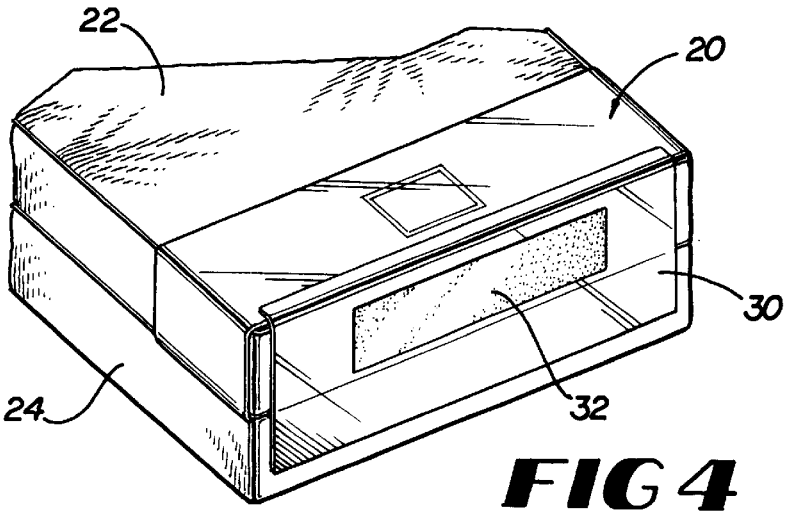
FIG. 4 is a partial perspective view of a mattress and box spring having a combined mattress cover and attached apron constructed in accordance with the invention.

FIG. 4 illustrates a preferred form of the invention wherein a mattress cover 20 is provided with an associated skirt 30 designed to overhang both the end of a mattress 22 and the associated box spring 24. In accordance with the invention, the skirt 30 may be provided with a panel 32 having suitable indicia thereon intended to identify the source, style, price and other information about the associated mattress 22. In a preferred form, the skirt 30 is attached to the cover 20 by hook and loop fastening means adhered to the end of the cover 20 such as is shown generally by the reference numeral 34 in FIG. 1.

It can now be appreciated that the cover 20 and skirt 30 assembly of the invention provides a highly effective means for preventing the mattress from being soiled during consumer testing and also for identifying the associated mattress characteristics in a prominent manner not heretofore achieved in the art. Consumers who test a particular mattress can readily identify the mattress even though it may be one of many mattresses on display in a showroom. While the invention is shown in its preferred form as provided with hook and loop fastening material, it will be appreciated that other means may be used to connect both the cover and the apron. For example, a grommet and hook arrangement may also be used if properly designed. Also, it has been found that where vinyl is used for the cover web, no fastening system at all may be required because vinyl would tend to adhere to itself at the overlap of the cover beneath the mattress.

While the present invention has been described in connection with preferred embodiments thereof, it will be apparent to those skilled in the art that many changes and modifications may be made without departing from the true spirit and scope of the present invention. Accordingly, it is intended by the appended claims to cover all such changes and modifications as come within the true spirit and scope of the invention.

What is claimed is:

1. A combined cover and apron for the foot of a mattress comprising:

a generally elongate web of flexible material dimensioned and configured to wrap around a foot portion of a mattress and overlap itself underneath the mattress; and an apron attachable at one of its ends to said web along the upper edge of the web such that said apron extends away from the web in one direction and hangs from said web adjacent to an end of an associated mattress.

2. The combined cover and apron of claim 1 wherein said web is secured to itself at overlapping portions by hook and loop fastening means attached to said web.

3. The combined cover and apron of claim 1 wherein said apron is attachable to said web by hook and loop fastening means.

4. The combined cover and apron of claim 1 wherein said web is constructed of clear plastic.

5. The combined cover and apron of claim 1 wherein said web is generally rectangular in shape.

6. The combined cover and apron of claim 1 wherein said web is approximately twenty inches in width.

7. The combined cover and apron of claim 1 wherein said apron is configured to cover both an end of an associated mattress and an end of an associated box spring.

8. The combined cover and apron of claim 1 wherein said apron has a panel bearing indicia.

9. A combined cover and apron for the foot of a mattress comprising:

a generally rectangular elongate web of clear plastic material dimensioned and configured to wrap around a foot portion of a mattress and attach to itself at overlapping portions by hook and loop fastening means secured to said web with said web having an upper edge disposed along an end of said mattress; and an apron attachable along said upper edge of said web and secured to said edge by hook and loop fastening means so as to hang down over said end of said mattress.

10. The combined cover and apron of claim 9 wherein said web is approximately twenty inches in width.

11. The combined cover and apron of claim 9 wherein said apron is configured to cover both said end of said mattress and an end of an associated box spring.

12. A combined cover and apron for the foot of a mattress comprising:

a generally elongate web of flexible material dimensioned and configured to wrap around a foot portion of a mattress and overlap itself underneath the mattress; and an apron attachable to said web along the upper edge of the web such that said apron hangs from said web adjacent to an end of an associated mattress, wherein said web is constructed of clear plastic.

13. A combined cover and apron for the foot of a mattress comprising:

a generally elongate web of flexible material dimensioned and configured to wrap around a foot portion of a mattress and overlap itself underneath the mattress; and an apron attachable to said web along the upper edge of the web such that said apron hangs from said web adjacent to an end of an associated mattress wherein said web is approximately twenty inches in width.

14. A combined cover and apron for the foot of a mattress comprising:

a generally elongate web of flexible material dimensioned and configured to wrap around a foot portion of a mattress and overlap itself underneath the mattress; and an apron attachable to said web along the upper edge of the web such that said apron hangs from said web adjacent to an end of an associated mattress wherein said apron has a panel bearing indicia.

* * * * *